US009611605B1

(12) United States Patent
Pennock

(10) Patent No.: US 9,611,605 B1
(45) Date of Patent: Apr. 4, 2017

(54) CANTILEVERED DEBRIS PLOW AND METHOD OF CLEARING DEBRIS

(71) Applicant: Elliott Pennock, DeWitt, IA (US)

(72) Inventor: Elliott Pennock, DeWitt, IA (US)

( * ) Notice: Subject to any disclaimer, the term of this patent is extended or adjusted under 35 U.S.C. 154(b) by 143 days.

(21) Appl. No.: 14/553,925

(22) Filed: Nov. 25, 2014

Related U.S. Application Data

(60) Provisional application No. 61/908,538, filed on Nov. 25, 2013.

(51) Int. Cl.
*B08B 3/00* (2006.01)
*E01H 6/00* (2006.01)
*E01H 5/09* (2006.01)

(52) U.S. Cl.
CPC ..... *E01H 6/00* (2013.01); *E01H 5/092* (2013.01); *E01H 5/098* (2013.01)

(58) Field of Classification Search
CPC ..... B08B 13/00; E01H 6/00; E01H 5/09
USPC ..... 134/93; 37/195, 231; 15/3, 78
See application file for complete search history.

(56) References Cited

U.S. PATENT DOCUMENTS 5,127,175 A * 7/1992 Atkinson ..... E01H 5/066 37/232
2013/0298429 A1* 11/2013 Niemela ..... E01H 5/04 37/242

* cited by examiner

*Primary Examiner* — Eric Golightly
(74) *Attorney, Agent, or Firm* — Hamilton IP Law, PC; Jay R. Hamilton; Charles A. Damschen

(57) ABSTRACT

A cantilevered debris plow comprising: a) A housing having a first end and a second end, wherein said first end is open for discharge of debris and said second end is closed for input of debris: b) A mounting plate configurable for attachment to a prime mover is attached to said housing, wherein said mounting plate is positioned between said first end and said second end of said housing and wherein the distance from said first end to said mounting plate is less than the distance from said second end to said mounting plate; and; c) A debris engager positioned in said housing to engage and convey debris from said first end to said second end of said housing for discharge.

17 Claims, 14 Drawing Sheets

CANTILEVERED DEBRIS PLOW AND METHOD OF CLEARING DEBRIS

CROSS REFERENCE TO RELATED APPLICATIONS

Applicant claims priority from U.S. Provisional Pat. App. No. 61/908,538 filed on Nov. 25, 2013, which is incorporated by reference herein in its entirety.

FIELD OF THE INVENTION

The present disclosure relates to a device for moving debris, such as snow, trash, dirt or other materials, accumulated upon parking surfaces which may impede use of the parking surface as found in a large parking lot or surrounding a warehouse complex, which may impede or interfere with movement of vehicles or trailers for attachment to vehicles.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. §1.171 (c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION

Brief Description of Drawings

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION - TABLE OF ELEMENTS

Figure 1:
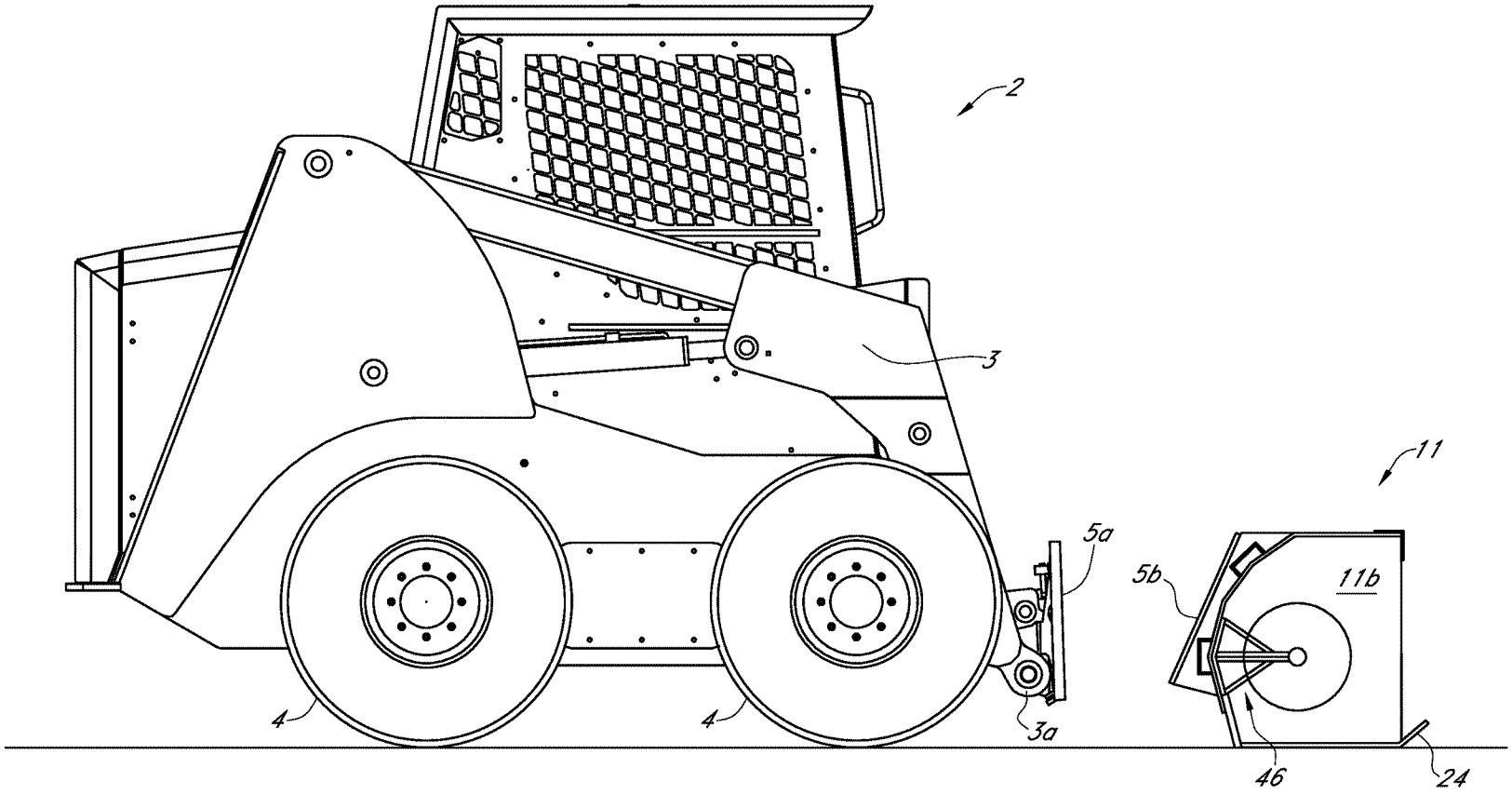
FIG. 1 is a side view of an illustrative embodiment and prime mover (shown as a skid steer) according to the present disclosure.

| Element Description | Element Number |
|---|---|
| Surface | 1 |
| Surface under trailer | 1a |
| Clean (bare) surface | 1b |
| Skidsteer (prime mover) | 2 |
| Loader arms | 3 |
| Loader arm pin end | 3a |
| Loader wheel | 4 |
| Loader wheel - debris inlet side | 4a |
| Loader wheel - debris outlet side | 4b |
| Attachment plate | 5 |
| Attachment plate - loader side | 5a |
| Attachment plate - accessory side | 5b |
| Trailer | 6 |
| Trailer box | 6a |
| Trailer frame | 6b |
| Trailer axle | 7 |
| | 8 |

-continued

| DETAILED DESCRIPTION - TABLE OF ELEMENTS | |
|---|---|
| Element Description | Element Number |
| Trailer hitch | 9 |
| Trailer dolly | 10 |
| Cantilevered Debris Plow (Plow) | 11 |
| Debris inlet (closed end) | 11a |
| Debris outlet (open end) | 11b |
| Housing | 12 |
| Housing height | 12a |
| Outer end section | 13 |
| Outer end dimension | 13a |
| Inner end section | 14 |
| Inner end section dimension | 14a |
| | 15 |
| Direction of debris travel | 16 |
| | 17 |
| Quick tach brace | 18 |
| | 19 |
| Frame | 20 |
| Vertical brace | 21 |
| Horizontal brace | 22 |
| Cutting edge | 23 |
| Cutting edge bolts | 23a |
| Skid shoe | 24 |
| Drive end enclosure | 25 |
| Protection plate | 26 |
| End plate | 27 |
| Angle iron guard | 28 |
| Flange bearing | 29 |
| Hydraulic pump | 30 |
| Hydraulic line | 31 |
| Pump enclosure | 32 |
| Adjustable jack | 33 |
| Adjustable jack handle | 34 |
| Jack mount | 35 |
| Caster wheel | 36 |
| Light | 37 |
| | 38 |
| | 39 |
| Augur (debris engager) | 40 |
| Auger shaft | 40a |
| Auger flighting | 40b |
| Augur sprocket | 41 |
| Drive shaft | 42 |
| Drive sprocket | 43 |
| Drive chain | 44 |
| Flange bearing | 45 |
| Hanger bearing assembly | 46 |
| Hanger bearing assembly bolts | 46a |
| Hanger bearing | 47 |

DETAILED DESCRIPTION OF INVENTION

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

No efficient mechanical process currently exists to remove snow or other debris that may accumulate on the parking surfaces under semi-trailers or other cantilevered structures. Current methods for removing snow from under semi-trailers include extra wide plows that leave windows under the trailers making it even more difficult for semi-tractors to hook up correctly. (Not shown) Offset box blades on skid steers or tractors allow for minimal snow capacity to be moved and significantly increase the amount of machine maneuvering and operator error. (Not shown) For example, operators must continually remove the box blade from underneath the trailers once the box blade is full of snow (approximately every 30-50' depending on the snow fall amount). Large/fixed angle plows with an offset mount are also currently used and present the same difficulties as a box plow, as previously discussed. (Not shown) The method of clearing snow or debris with large/fixed angle plows offers even less snow carrying capacity and requires the operator to essentially make repeated "swoops" or "passes" under the semi-trailers increasing the possibility of accidents and property damage.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

FIG. 1 provides a simplified side view of an illustrative embodiment of the cantilevered debris plow of the present disclosure. As shown, the cantilevered debris plow 10 is attached to a skid steer loader 2 having loader arms 3 via a skid steer loader universal quick attach plate (attachment plate) 5 secured to the housing 12. Attachment plate 5 is constructed such that the loader side 5*a* is can be detached or attached via the pins as typically found at the end of loader arms 3*a*. On the attachment or accessory side, the plate 5*b* is typically secured attached to the attachment or accessory and allows quick attaching or coupling with the loader side 5*a* by pushing the plate 5*a* up and into the ("scooping up") the attachment or accessory. This type of quick tach type plate and set-up as shown here are well known to one of ordinary skill and typically designed to fit any model of skid steer loader or tractor having a loader mounted therein including models built by Bobcat, Case, ASV, Gehl, John Deere, New Holland and/or Caterpillar. One of ordinary skill will appreciate that housing 12 may be attached to the loader arms 3 in a multitude of ways other than with attachment plate 5 including by pins, rods and hitches and or combinations therein without departure from the spirit and intent of the present disclosure.

Figure 2:
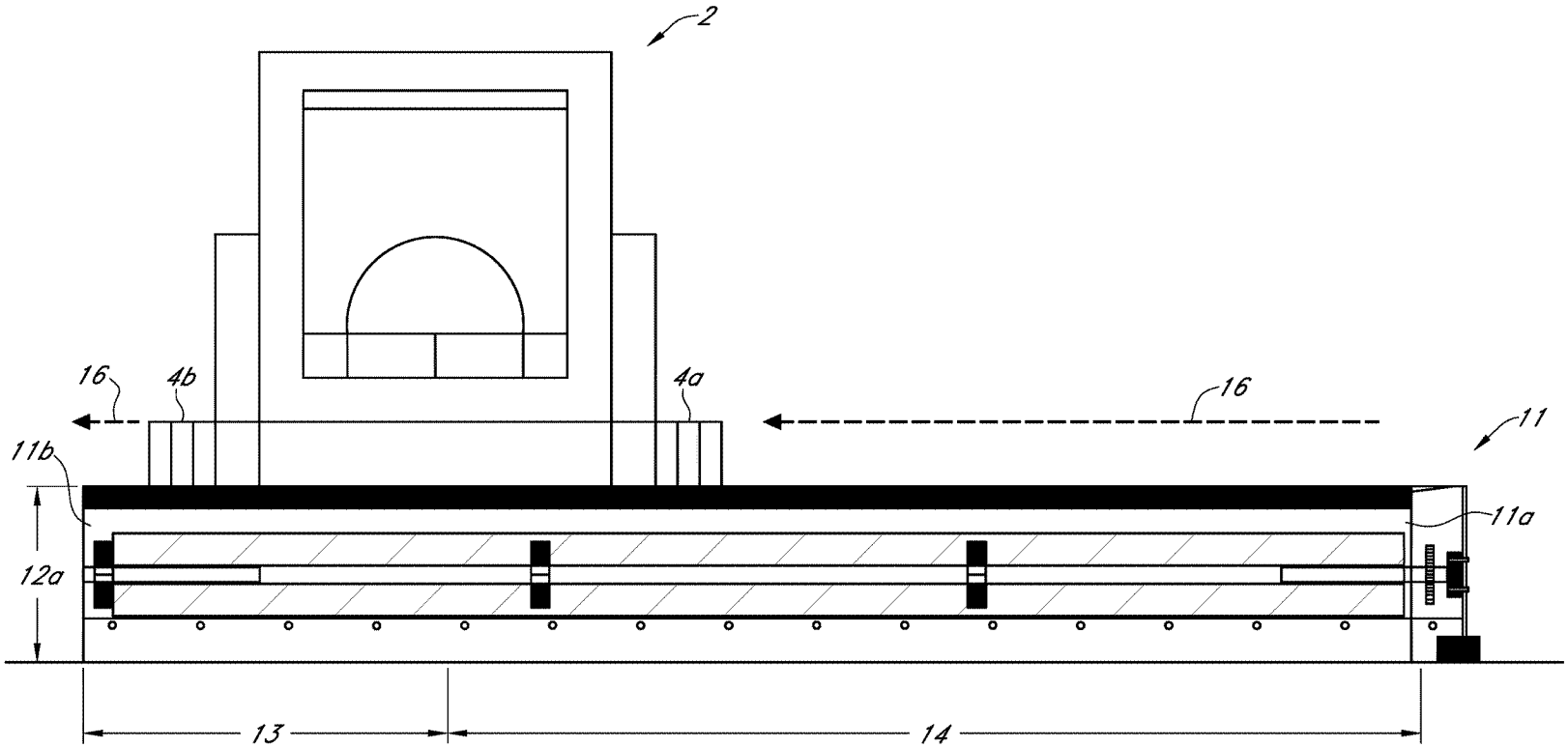
FIG. 2 is a front view of an illustrative embodiment and prime mover (shown as a skid steer) according to the present disclosure.
Figure 3:
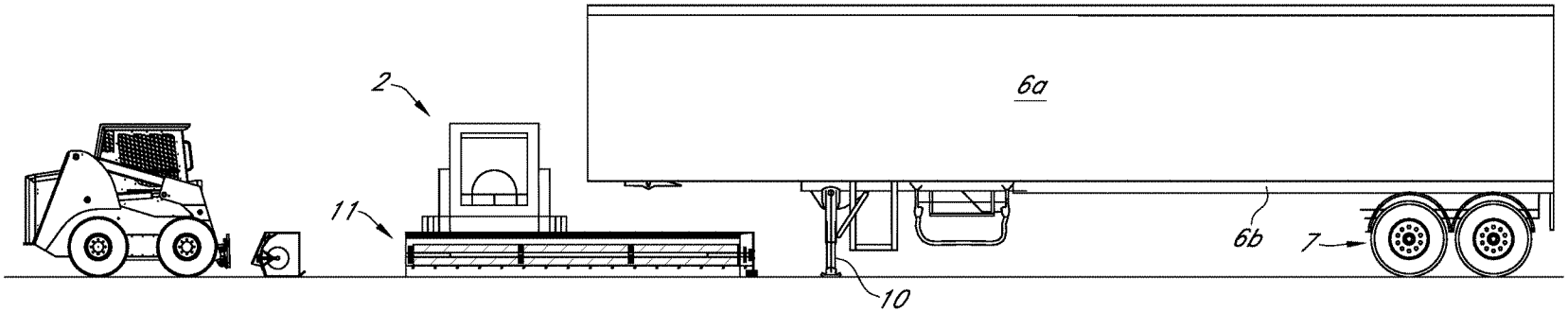
FIG. 3 is a view provided for perspective combing FIGS. 1 and 2 illustrating the illustrative embodiment positioned with a semi-trailer according to the present disclosure.
Figure 3A:
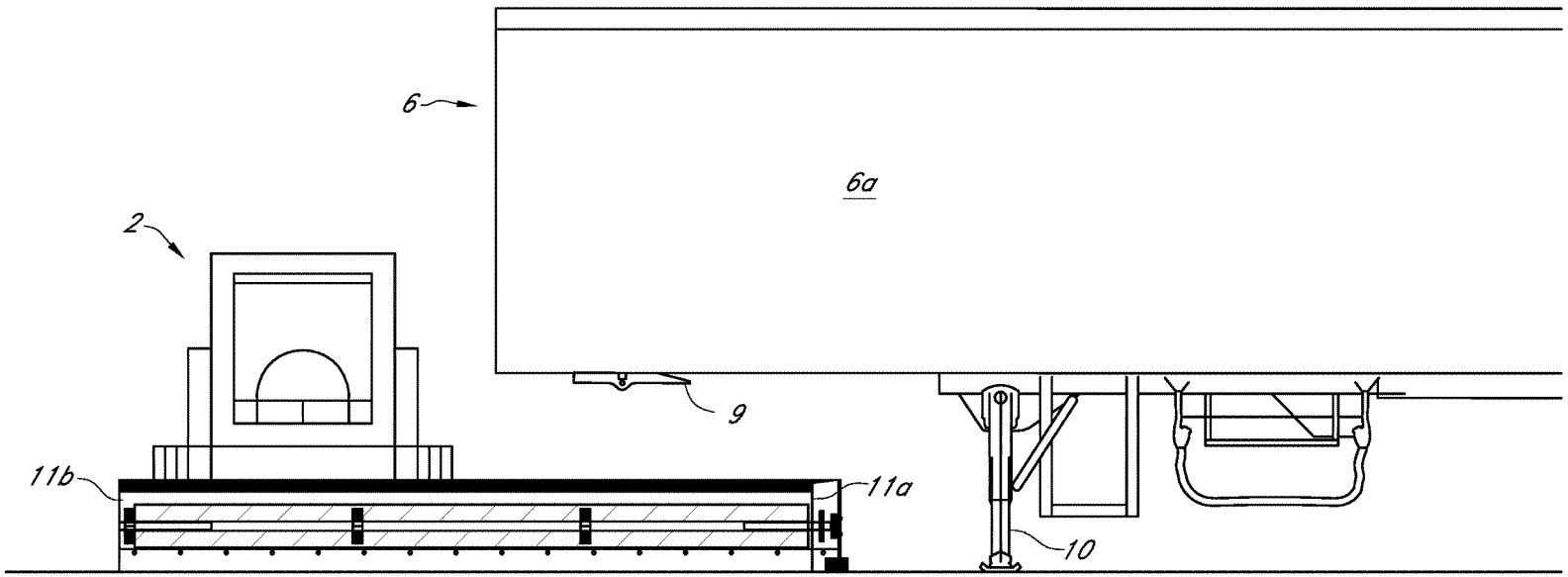
FIG. 3A is a detailed front view of the illustrative embodiment according to FIG. 3 and further providing relative dimensions useful in understanding the problem solved by the present disclosure.

FIG. 2 is a front view of an illustrative embodiment of the cantilevered debris plow illustrating its asymmetric nature i.e. attachment plate 5 is not attached to the housing 12 at its middle or center. FIG. 3 is a view provided for perspective combing FIGS. 1 and 2 illustrating the illustrative embodiment positioned with a canti-levered semi-trailer 6 according to the present disclosure. FIG. 3A is a detailed front view of the illustrative embodiment according to FIG. 3 and further providing relative dimensions useful in understanding the problem solved by the present disclosure. As shown throughout, the housing 12 of the cantilevered debris plow 11 ("hereinafter referred to exclusively as "plow") has a total length of 15.71 feet and is defined as having a debris inlet end 11*a* and debris outlet end 11*b*. The debris inlet end 11*a* extends a considerable distance away from the prime mover 2 and is distal to the prime mover 2. A skidshoe 24 is affixed to the frame of the plow 11 on the underside to support the distal end at the end plate 27. (See also FIGS. 4, 5 and 6) Additionally an adjustable jack 33 attached via the jack mount 35 allows for adjustment of the tension placed upon the skidshoe 24 during operation as more or less weight can be placed on skidshoe 24 by raising or lowering the jack 33 and engagement of the caster wheel 36 with surface 1. During transit, the adjustable jack 33 may be fully lowered thereby raising skidshoe 24 off the surface 1 allowing for raised transit without engagement with surface 1. Those of ordinary skill will appreciate that the loader arms 3 may be raised or lowered as well for operation or transit of plow 11. (Not shown) Additionally, although not shown, one of ordinary skill will understand that the manual adjustable jack 33 herein may be replaced with a hydraulically actuated version without departure from the spirit and intent of the present disclosure. To assist with clearing operations and operator guidance a light 37 may be positioned on the housing 12 at either or both ends of the housing.

Figure 13:
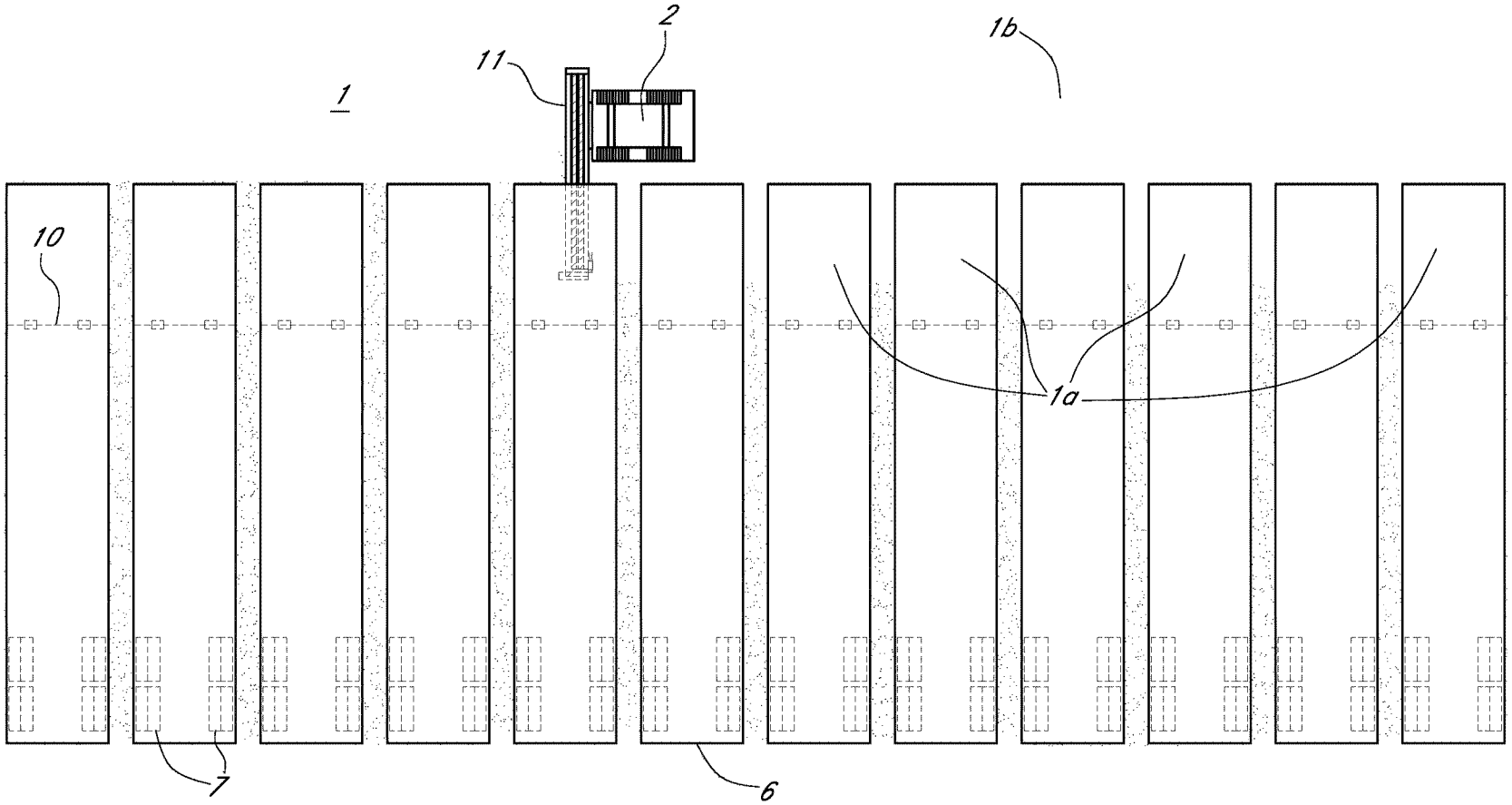
FIG. 13 provides an overview of a parking lot having a plurality of semi-trailers parked in support of using an embodiment of the present disclosure to remove debris from under the semi-trailers parked therein.

As shown in FIGS. 3 and 3A, a semi-trailer 6 is an example of a cantilevered structure having at least one axle 7 is positioned at the rear of the trailer while the dolly of the trailer 10 supports the front end of the semi-trailer leaving a certain amount of the semi-trailer supported by the trailer dolly and hanging over the trailer dolly. This presents a problem because semi-tractors or other prime movers (not shown) are unable to be properly hitched to the semi-trailer 6 due to the accumulated snow or other debris interfering with proper placement of the semi-tractor under the trailer and for connection with the trailer hitch. (Not shown) Often times this leads to semi trailers 6 becoming disconnected and falling to the ground causing damage and even injury. Further, as illustrated in FIG. 13, the large scale of the modern parking lot surrounding a warehouse and the typical higher costs of labor, a solution is needed does not require manual labor for removal of accumulated debris under this particularly hard to reach surfaces.

The area of the parking surface covered by the cantilevered trailer 6 is defined by the width of the trailer in a first dimension and the distance from the front of the trailer to the trailer dolly 10 of the trailer 6 in a second dimension. Typically, the trailer hitch 9 is positioned between the front of the semi-trailer and the trailer dolly 10. A third dimension is the distance from the parking surface to the bottom of the trailer which is heretofore defined as the trailer clearance (height). One of ordinary skill will further appreciate from the present disclosure and figures that this third dimension also increases the difficulty and cost of solving this problem.

As shown the housing 12 on the first end extends between 1-2 feet past the outer width of the skid steer (prime mover) as illustrated by outer wheel 4*b* creating an outer end section 13 having an outer end dimension 13*a* of approximately five (5) feet from the center of the attachment plate 5. The housing 12 on the debris inlet end 11*a* extends past the inner wheel 4*a* in the range of 8-10 feet creating an inner end section 14 having an inner end section dimension 14*a* of 10-11 feet. Further, as shown, the plow 11 is constructed with a housing height dimension of two (2) feet allowing a clearance of almost two (2) feet under the cantilevered portion of the trailer defined as the portion between the front of the trailer and the trailer dolly. As the dimensions of the trailer frame 6*b* height and the distance the trailer hitch 9 hangs down may vary, this is considered to be a reasonable clearance but is only one of many clearances which may be suitable for a particular application. One of ordinary skill will appreciate that the combination of the longer inner section 14 and the low profile of the plow 11 allows it to reach under the front portion of the trailer to remove accumulated debris positioned therein. One of ordinary skill will appreciate that other dimension combinations are possible that are suitable, dependent upon the particular application, for removal of accumulated debris from a parking surface 1*a* under a cantilevered trailer 6.

FIGS. 4-12 illustrate and enable one embodiment of a plow 11 having an augur 40 positioned therein that may be engaged with a skid steer or other prime mover 2. As discussed infra, a portion of the plow 11 may be positioned under an end of a semi-trailer or other cantilevered structure, as shown in FIGS. 2-3 and 13.

Figure 4:
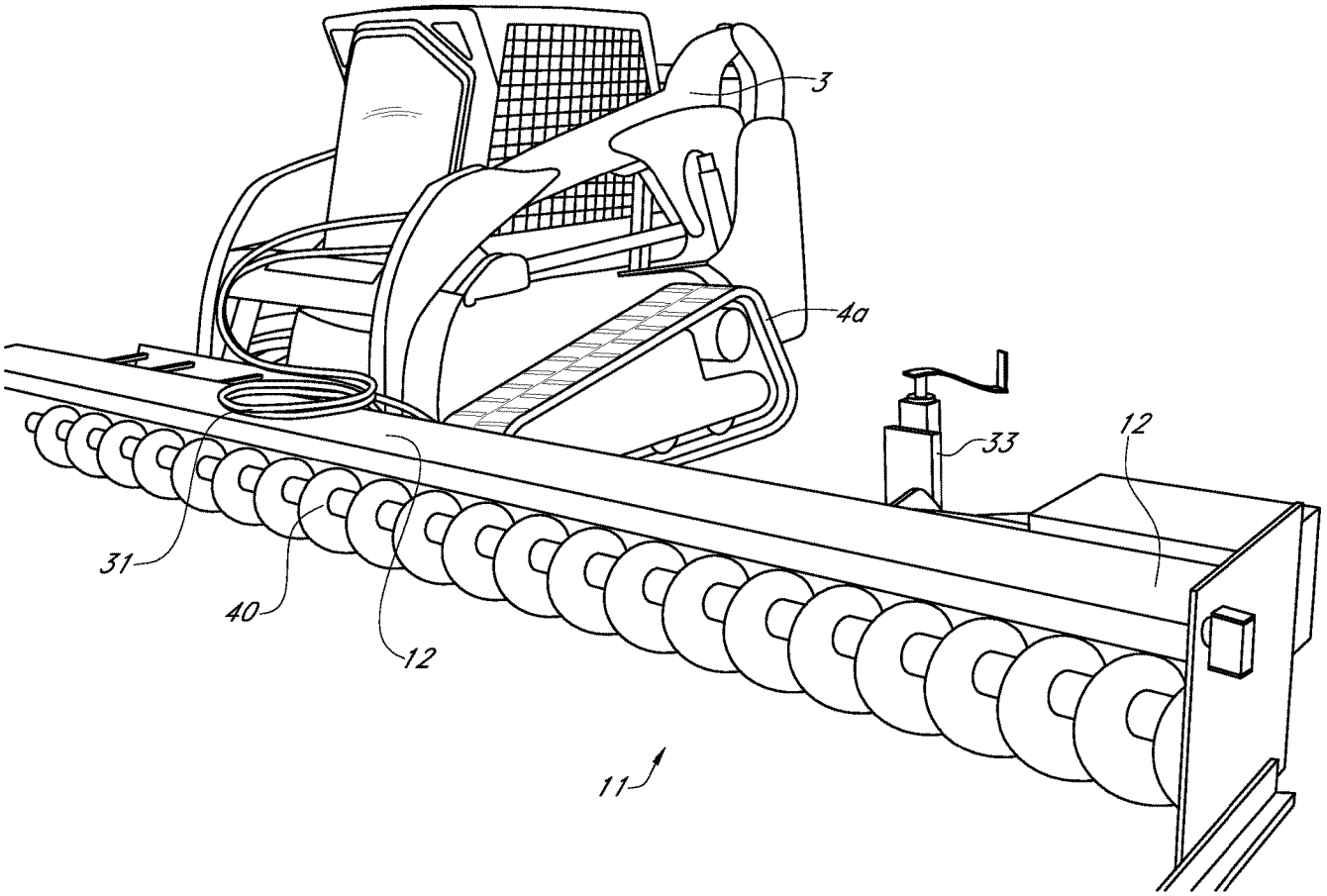
FIG. 4 provides a front perspective view of the cantilevered debris plow of the illustrative embodiment according to the present disclosure attached to a prime mover skid steer.

FIG. 4 provides a front perspective view of the plow 11 showing the offset in lengths between the inlet and discharge ends of the plow attached to a prime mover (shown as as a skid steer 2) previously discussed. As one of ordinary skill will appreciate that debris inlet side loader wheel (4*a*) of the skid steer may be replaced or substituted with tracks without limitation or restriction, as suitable for the particular application and or conditions.

As best illustrated by FIGS. 4, 5, 6 and 7, the housing 12 of the plow 11 is constructed of steel in the exemplary models shown. The housing 12 is compromised of a frame 20 illustrated as a "straightened" curved shape (see end view FIG. 6) having both vertical 21 and horizontal braces 22 supporting the augur 40 positioned therein. As previously discussed, an attachment (mounting) plate 5*b* is affixed to the frame 20 with additional bracing on either side of the mounting plate 5*b* to enhance structural rigidity necessary support the cantilevered design. The plow 11 and various elements thereof may be constructed of any material known to those skilled in the art that is appropriate for the specific application thereof. For example, steel, metallic alloys, synthetic materials, natural materials, combinations thereof, and/or any other suitable material may be used without limitation. Although not shown, one of ordinary skill will appreciate that the mounting plate may be affixed to the housing and supporting frame by any number of methods includes by welding or by use of typical fasteners well known to those of ordinary skill in the art. In other embodiments, not shown, additional horizontal and or vertical rails may be affixed to the housing. Saddles that cooperatively engage with the rails may then be affixed to the mounting plate 5*b*. The horizontal and or vertical rails in combination with attachment of additional hydraulic cylinders would then allow further adjustment of the vertical and or horizontal position of the plow 11 in relation to the prime mover 2. For example, the addition of horizontal rails and a hydraulic cylinder may allow the operator to advance or retract the debris inlet end in relation to the prime mover increasing utility in reaching further under trailers or easy entry into and through parking lot gates.

Figure 5:
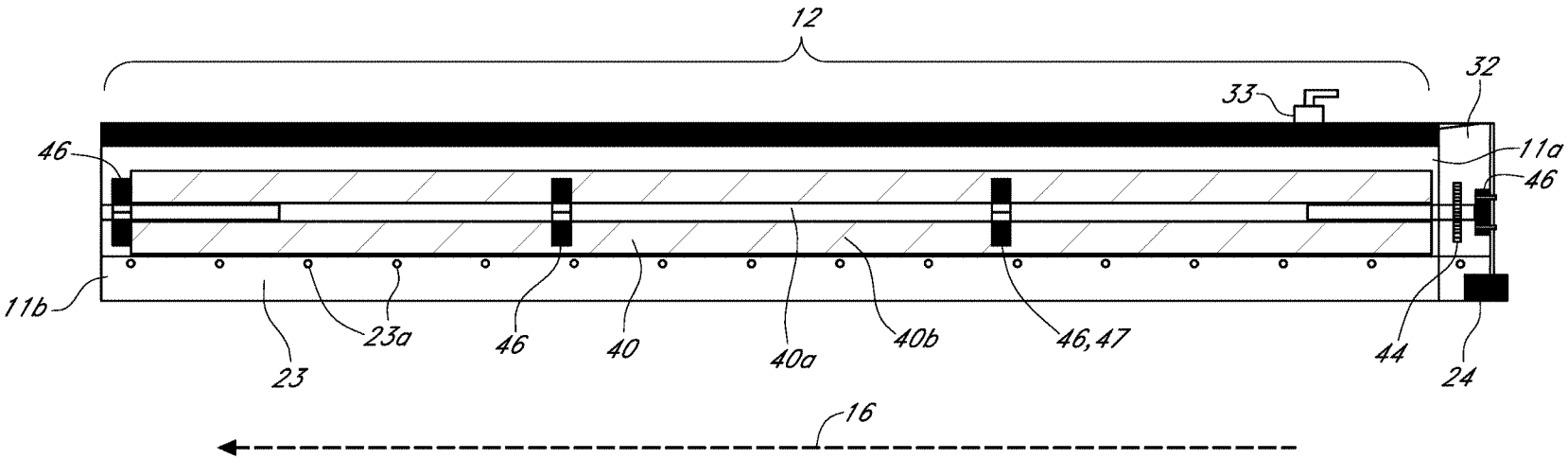
FIG. 5 provides a detailed front view of the cantilevered debris plow of the illustrative embodiment according to the present disclosure.
Figure 12:
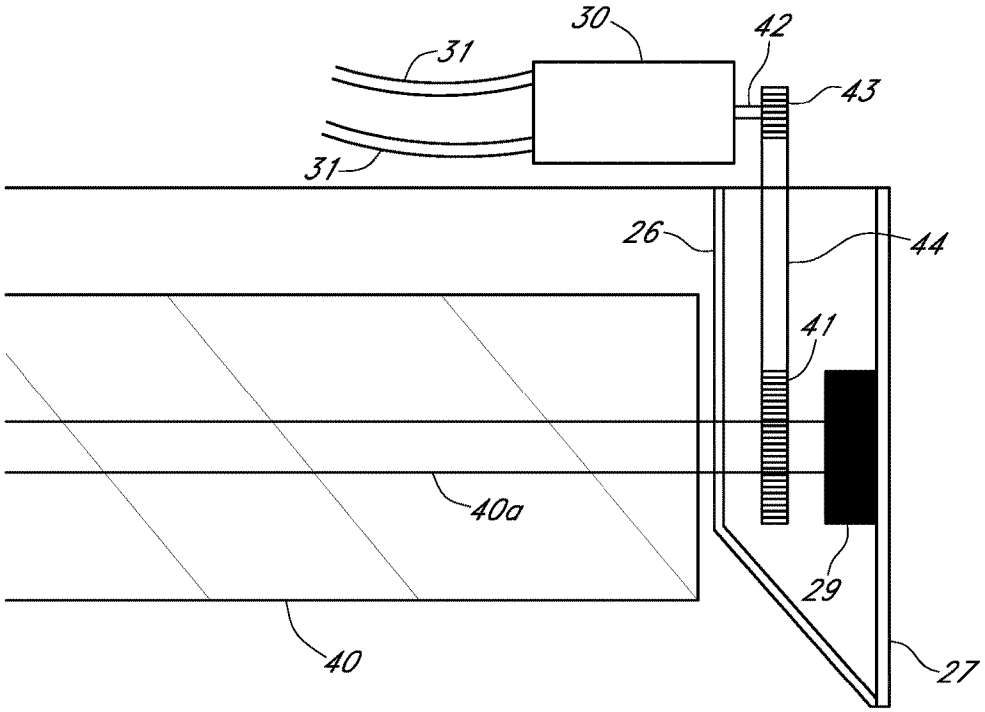
FIG. 12 provides a detailed top view of the inlet end of the embodiment of the plow disclosed herein with particular detail of the components enclosed behind the protection plate as illustrated in FIG. 11.

As shown in FIGS. 5 and 12, the debris inlet end 11*a* is closed or solid. As shown, the hydraulic pump 30 and its drive components (drive shaft 42, drive sprocket 43, drive chain 44) are positioned at debris inlet end 11*a*. Hydraulic lines 31 and hydraulic pump 30 sit on the rear side of the housing and are affixed to the housing therein and protected by pump enclosure 32, which is removable as needed for maintenance or replacement of hydraulic lines 31 and hydraulic pump 30, as needed. Hydraulic pump 30 and its drive components are integrated into housing 12 and frame 20. As the plow 11 shown is subject to severe loads caused by engaging and driving through snow and ice, the drive components for the plow 11 are secured within and protected by drive end enclosure 25 having external protection plate 26. Drive chain 44 is coupled to the auger sprocket 41 affixed to auger shaft 40*a* to rotatably drive the auger 40 having auger flighting 40*b* for contact and engagement with debris to be removed when energized by the hydraulic system and pump 30. The auger 40 is secured within housing 12 with its auger shaft 40*a* supported by a combination of bearings secured within frame 20 of housing 12. At the debris inlet side, the auger 40 is secured within the housing by flange bearing 29 affixed to the interior of end plate 27 and auger shaft 40*a* positioned therein. The auger 40 as shown has a diameter of 11.25 inches. One of ordinary skill will appreciate that other dimensions are possible without departure from the spirit and intent of the present disclosure.

Figure 11:
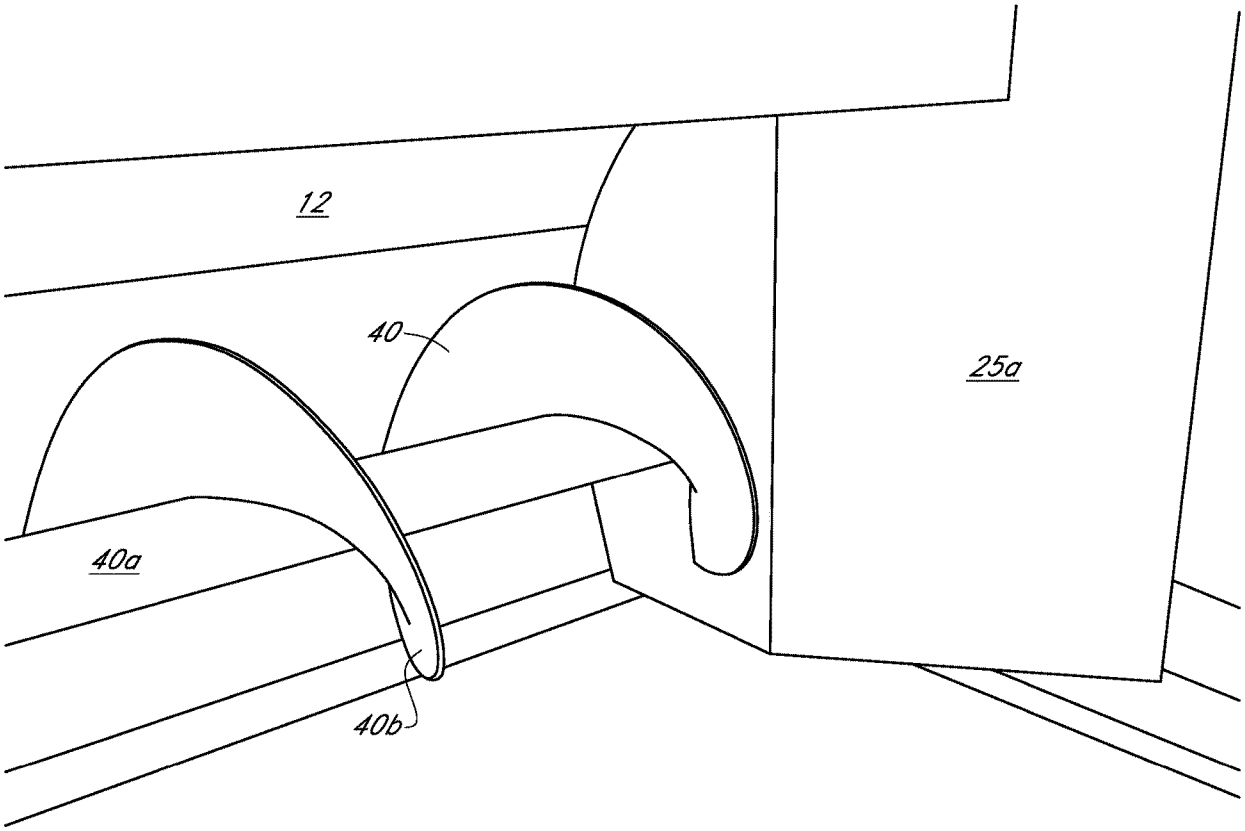
FIG. 11 provides a detailed view of the illustrative embodiment according to the present disclosure of the rear side of the embodiment of a cantilevered debris plow disclosed herein with additional detail of the debris inlet end.

FIG. 11 provides a detailed view of the front side of the debris inlet side of the plow 11 with protection plate 26 in plate. As shown in the top of FIG. 12, the pump 30 is affixed to and positioned on the back side of the plow 11 with the drive chain 44, auger sprocket 41 affixed to auger shaft 40*a* and flange bearing 29 secured behind the protection plate 26. One of ordinary skill will appreciate that other drive configurations are possible without departure from the spirit and intent of the present disclosure.

Figure 6:
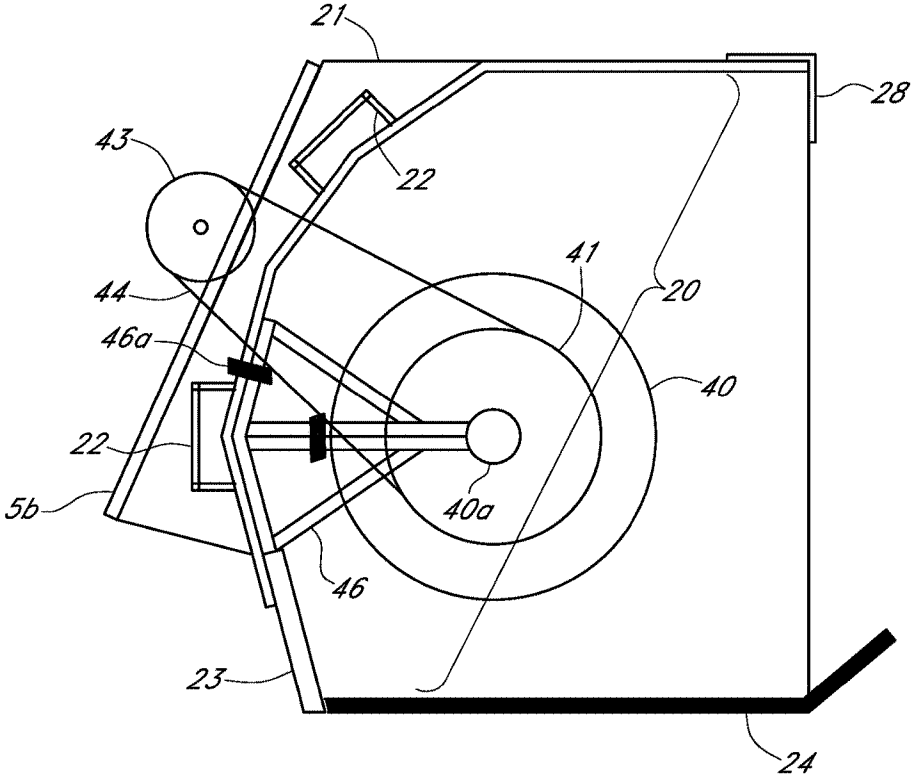
FIG. 6 provides a cross-sectional view of the illustrative embodiment according to the present disclosure from the debris outlet end of the embodiment of a cantilevered debris plow disclosed herein.
Figure 7:
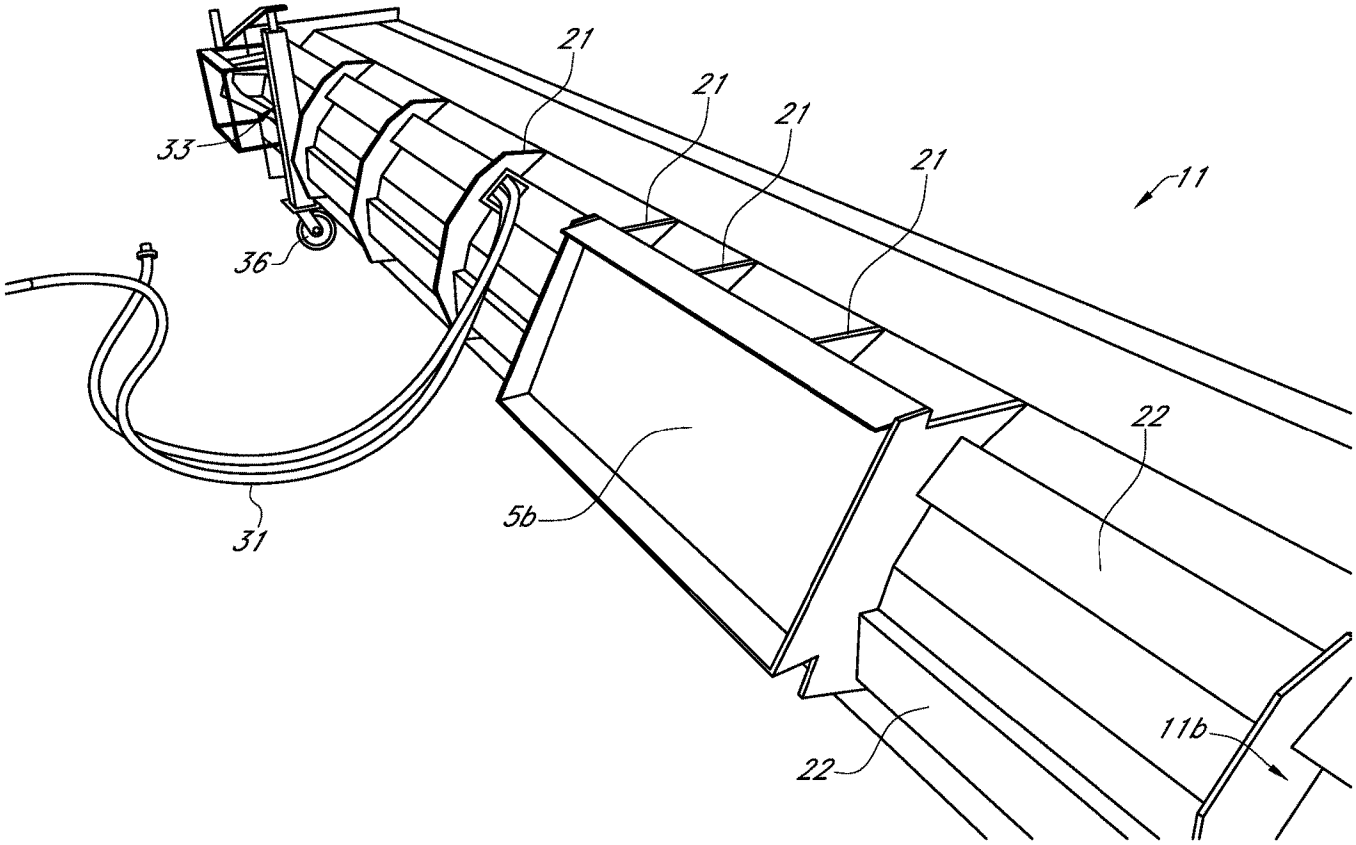
FIG. 7 provides a perspective view of the illustrative embodiment according to the present disclosure from the debris outlet end of the embodiment of a cantilevered debris plow disclosed herein before attachment to the primary mover.

FIG. 6 provides a cross-sectional view of the debris outlet end of the plow 11 disclosed herein and FIG. 7 provides a perspective view of the plow 11 from the debris outlet end 11*b* disclosed herein unattached to primary mover 2. As shown, the debris outlet end 11*b* is open. As best illustrated by FIG. 6, auger 40 and auger shaft 40*a* are secured and supported within housing 12 at debris outlet end 11*b* by a number of hanger bearing assemblies 46 affixed to the frame 20 of housing 11 by a number of hanger bearing assembly bolts 46*a*, as shown. A hanger bearing 47 is positioned within each hanger bearing assembly 46, with auger shaft 40*a* positioned in and through the hanging bearing 47. This particular combination of structure (hanger bearings 46/hanger bearing assembly 47) allows the debris outlet end 11*a* to have an open configuration. One of ordinary skill will appreciate that other bearing and bearing support configurations are possible without departure from the spirit and intent of the present disclosure.

Figure 8:
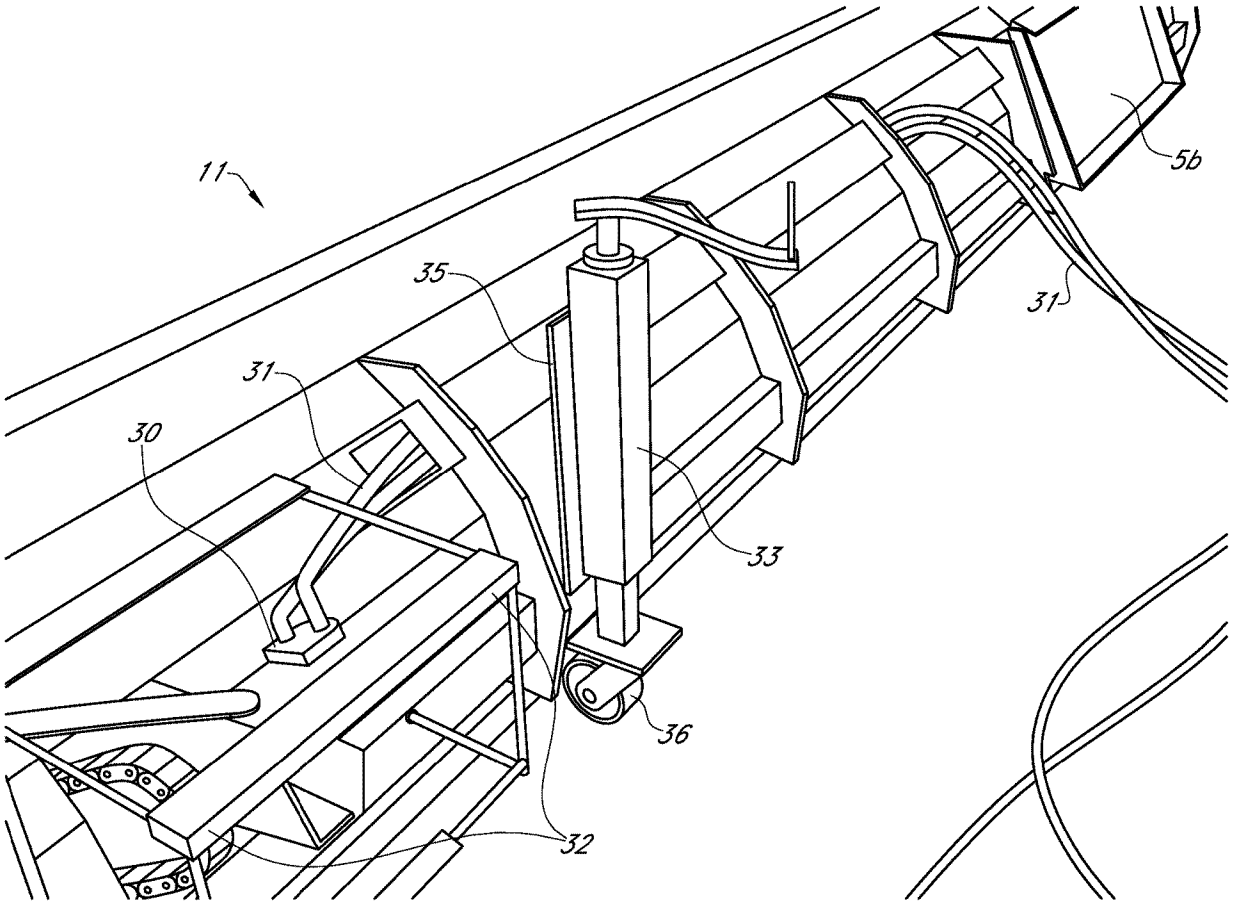
FIG. 8 provides a perspective view of the illustrative embodiment according to the present disclosure from the debris inlet end of the embodiment of a cantilevered debris plow disclosed herein before attachment to the primary mover.
Figure 9:
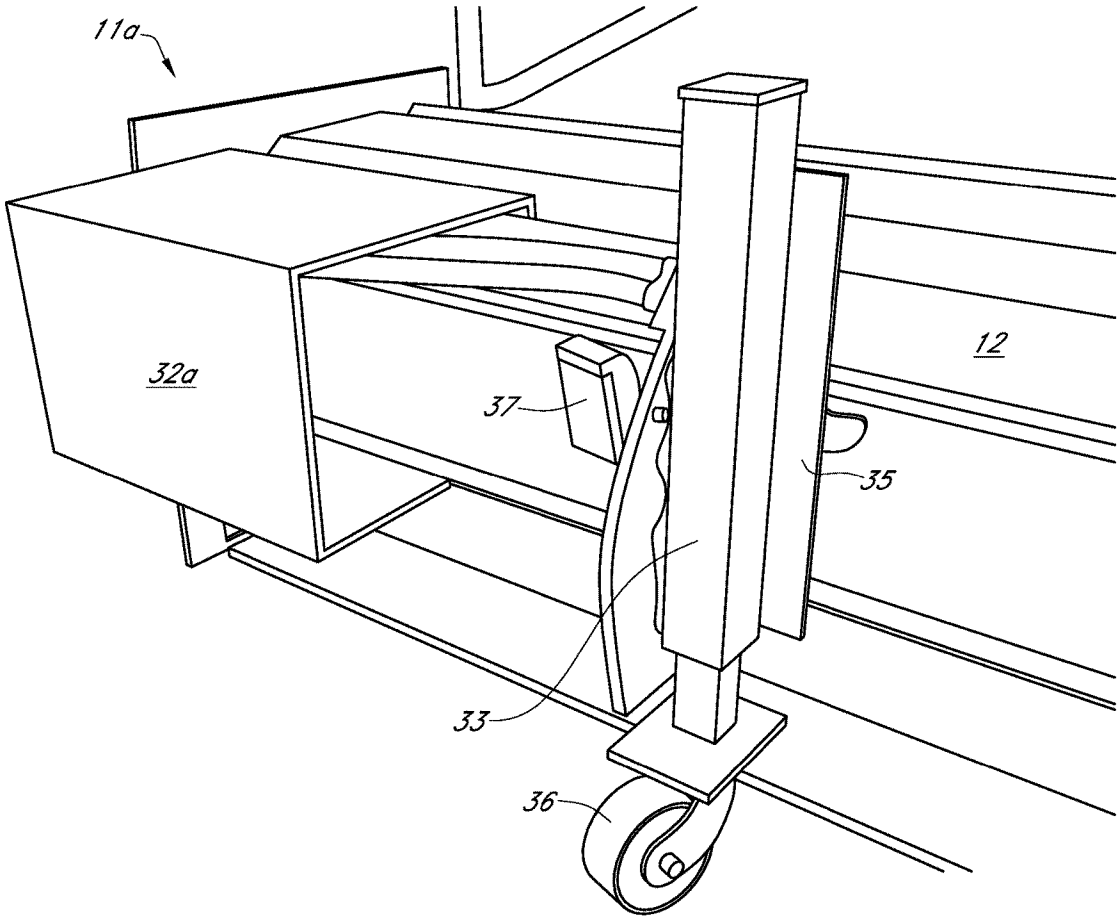
FIG. 9 provides a detailed view of the illustrative embodiment according to the present disclosure of the rear side of the embodiment of a cantilevered debris plow disclosed herein with additional detail of the debris inlet end with the pump enclosure in place.
Figure 10:
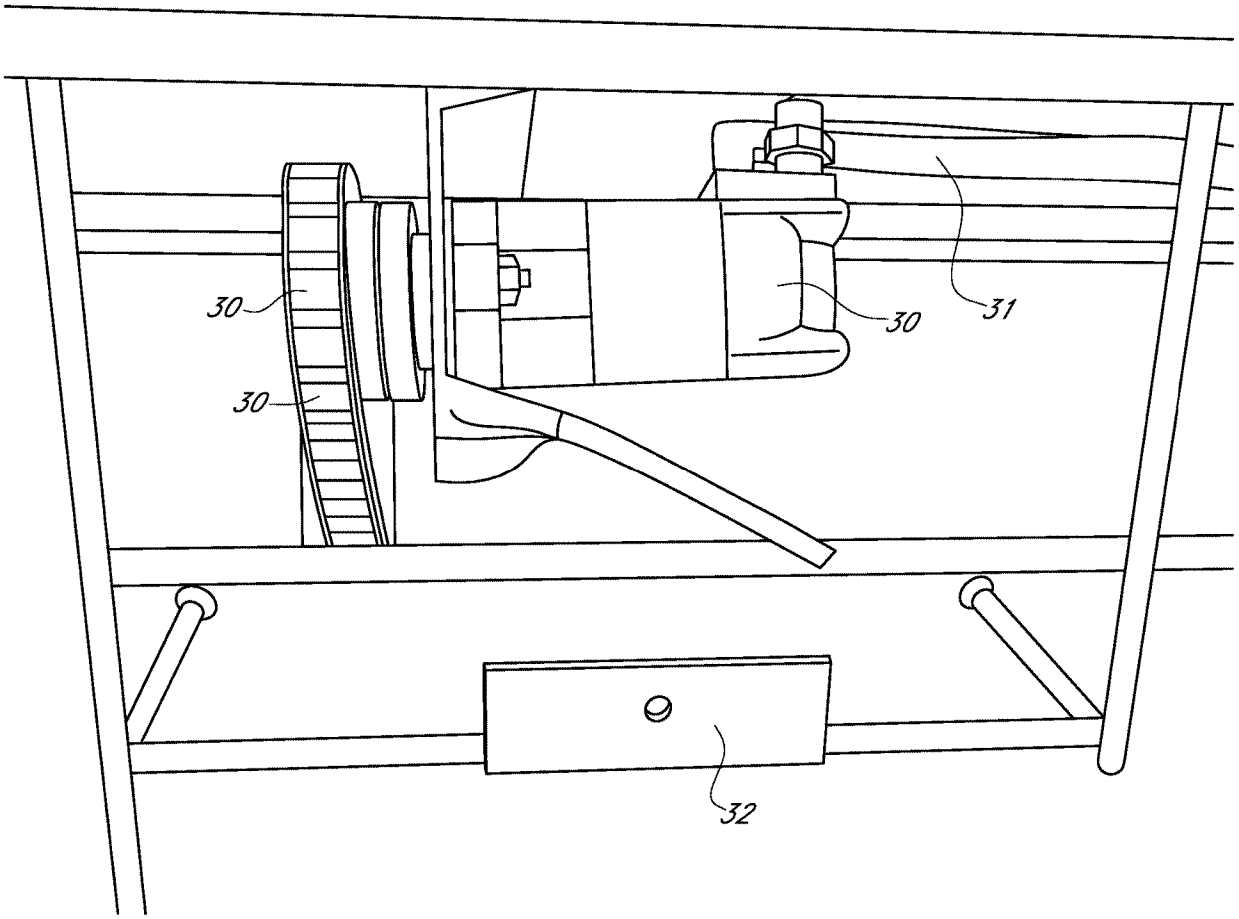
FIG. 10 provides a detailed view of the illustrative embodiment according to the present disclosure of the rear side of the embodiment of a cantilevered debris plow disclosed herein with additional detail of the debris inlet end with the pump enclosure in place.

As best shown by FIGS. 4, 7 and 8, the plow 11 may be configured so that the skid steer or other prime mover 2 to receive energy from the prime mover via a power take off, compressed fluid source, or any other energy source without limitation (e.g., pneumatic, electrical, etc.) to power the debris moving system of the plow 11, shown through-out as an auger without limitation. Although not shown, one of ordinary skill will appreciate that other types of powered debris moving systems could be used with the present apparatus and method including without limitation or restriction powered system having bristles or brushes allowing for removal of accumulated debris including trash, dirt, dust, fines, and or snow, as suitable for the particular application. As shown throughout in the following figures, applicant has chosen a prime mover 2 having a hydraulic system (not shown) using typical hydraulic lines 31 and a hydraulic pump (aka drive motor) 30 to power rotation of the auger 40 allowing for engagement and removal of accumulated snow from the surfaces engaged.

It should be noted that the plow is not limited to the specific embodiments pictured and described herein, but is intended to apply to all similar methods and apparatuses for removing snow or other debris from under a cantilevered structure. Accordingly, modifications and alterations from the described embodiments will occur to those skilled in the art without departure from the spirit and scope of the plow. It is understood that the plow as disclosed and defined herein extends to all alternative combinations of one or more of the individual features mentioned or evident from the text and/or drawings. All of these different combinations constitute various alternative aspects of the plow. The embodiments described herein explain the best modes known for practicing plow and will enable others skilled in the art to utilize the same. The claims are to be construed to include alternative embodiments to the extent permitted by the prior art.

Having described the preferred embodiment, other features, advantages, and/or efficiencies of the plow will undoubtedly occur to those versed in the art, as will numerous modifications and alterations of the disclosed embodiments and methods, all of which may be achieved without departing from the spirit and scope of the plow.

What is claimed is:

1. A cantilevered debris plow comprising:

a) A housing having a first end and a second end, wherein said first end is open for discharge of debris and said second end is closed for input of debris;

b) A mounting plate configurable for attachment to a prime mover and attached to said housing, wherein said mounting plate is positioned between said first end and said second end of said housing and wherein the distance from said first end to said mounting plate is less than the distance from said second end to said mounting plate; and;

c) A debris engager positioned in said housing to engage and convey debris from said second end to said first end of said housing for discharge.

2. The cantilevered debris plow according to claim 1 wherein said debris engager is configured for powered movement from an external source.

3. The cantilevered debris plow according to claim 1 wherein said powered debris engager consists of an auger.

4. The cantilevered debris plow according to claim 1 wherein said debris engager is suitable for engagement and removal of snow, ice, dirt, dust, trash, fines and or a combination therein.

5. The cantilevered debris plow according to claim 1 wherein said debris engager is an auger and powered by a hydraulic pump affixed to said housing, said hydraulic pump powered by an external hydraulic system coupled with said prime mover via a hydraulic line.

6. The cantilevered debris plow according to claim 2 wherein said external source of power to said and for said debris engager is hydraulic.

7. The cantilevered debris plow according to claim 1 wherein said prime mover consists of a tractor, a tractor having a mounted loader or a skid steer loader.

8. The cantilevered debris plow according to claim 1 wherein said mounting plate is configured for attachment to the loader arms of a skid steer loader.

9. The cantilevered debris plow according to claim 8 wherein said housing has a frame having an underside configured with a skidshoe proximate said closed debris inlet end.

10. The cantilevered debris plow according to claim 1 wherein said housing has a frame having an underside configured with a skidshoe and an adjustable jack with a caster wheel proximate said closed debris inlet end.

11. A cantilevered debris plow comprising:

a) A housing having a first end and a second end, wherein said first end is open and configured for debris discharge and said second end is closed and configured for debris reception and collection;

b) A mounting plate configurable for attachment to a prime mover is attached to said housing, wherein said mounting plate is positioned between said first ends and said second ends of said housing and wherein the distance from said first end to said mounting plate is less than the distance from said second end to said mounting plate; and;

c) An auger positioned in said housing to engage and convey debris from said second end to said first end of said housing.

12. The cantilevered debris plow according to claim 11 wherein said second end is configured as an end plate having a flange bearing configured therein to support and engage one end of said auger.

13. The cantilevered debris plow according to claim 12 wherein said first end is open and configured therein to support and engage said first end of said auger via a hanger bearing assembly having a hanging bearing therein.

14. The cantilevered debris plow according to claim 13 wherein a hydraulic pump is attached to said housing and coupled to a chain drive system connected to said auger to power said auger positioned therein.

15. The cantilevered debris plow according to claim 12 wherein said first end is open and configured therein to support and engage a first end of said auger via a hanger bearing assembly having a hanging bearing therein, the cantilevered debris plow configured for hydraulic connection to the hydraulic system of a prime mover to power a hydraulic pump mounted to said housing and coupled to a chain drive system, said chain drive system coupled to said auger positioned therein for powered operation of said auger.

16. The cantilevered debris plow according to claim 15 wherein said cantilevered debris plow housing has a height suitable to fit under a cantilevered front portion of a parked trailer.

17. The cantilevered debris plow according to claim 15 wherein said housing height is two feet.

* * * * *